United States Patent [19]

Iida et al.

[11] Patent Number: 4,555,648

[45] Date of Patent: Nov. 26, 1985

[54] ELECTRONIC FLASH UNIT UTILIZING PRE-FLASH ILLUMINATION OF FLASHTUBE

[75] Inventors: Yoshikazu Iida, Chigasaki; Nobuyoshi Hagyuda, Tokyo, both of Japan

[73] Assignee: Nippon Kogaku K.K., Tokyo, Japan

[21] Appl. No.: 521,346

[22] Filed: Aug. 8, 1983

[30] Foreign Application Priority Data

Aug. 13, 1982 [JP] Japan ..... 57-139695

[51] Int. Cl.[4] ..... H05B 41/32

[52] U.S. Cl. ..... 315/241 P; 315/150; 354/145.1

[58] Field of Search ..... 315/241 P, 150, 339; 354/145.1

[56] References Cited

U.S. PATENT DOCUMENTS

| | | | |
|---|---|---|---|
| 3,127,112 | 3/1964 | McCammon et al. | 315/241 P |
| 4,246,513 | 1/1981 | Pettit et al. | 315/150 |
| 4,369,395 | 1/1983 | Stempeck | 315/241 P |

*Primary Examiner*—David K. Moore
*Assistant Examiner*—Vincent DeLuca
*Attorney, Agent, or Firm*—Fitzpatrick, Cella, Harper & Scinto

[57] ABSTRACT

An electronic flash unit for emitting flashlight toward an object to be photographed in order that a camera may obtain proper exposure comprises flash means having a flash tube which emits flashlight, means for driving the flash tube in order that the flash tube may emit flashlight, and means for applying light to the interior of the flash tube prior to the driving means causing the flash tube to emit flashlight.

5 Claims, 13 Drawing Figures

ELECTRONIC FLASH UNIT UTILIZING PRE-FLASH ILLUMINATION OF FLASHTUBE

BACKGROUND OF THE INVENTION

1. Field of the Invention

This invention relates to an electronic flash unit, and more particularly to an electronic flash unit in which the noise produced during the excitation of the gas in the flash discharge tube is reduced.

2. Description of the Prior Art

Various electronic flash units have heretofore been proposed. For example, there is an automatic flash output control type electronic flash unit provided with a flash discharge tube having xenon gas or the like enclosed therein, a main capacitor charged with electrical energy for flash discharging, a trigger circuit for exciting the flash discharge tube at a high voltage in synchronism with the operation of a synchro contact (X contact) and starting flashlight emission by the charged energy of the main capacitor, and a light emission stopping circuit for stopping the flashlight emission when the quantity of emitted flashlight reaches a predetermined value (U.S. Pat. No. 4,228,381). Every electronic flash unit, including one of the automatic flash output control type, has a trigger circuit for causing the flash discharge tube to emit light, and vicious noise is discharged during operation of this trigger circuit. On the other hand, the latest cameras are advanced in automatization such as automatic exposure control, automatic focus adjustment or the like and along therewith, the electronic circuits are complicated and such cameras are sensitive to noise. Likewise, electronic flash units are also advanced in electrification and are sensitive to noise. Therefore, from the standpoint of preventing malfunctioning, improved noise margin of each circuit and a shield for intercepting the noise become necessary to reduce the influence of the noise discharged from the trigger circuit. This leads to a problem that the electronic flash unit and the electric circuits of cameras become expensive.

Also, the flashlight emission of the flash discharge tube is affected by the brightness of the outside. That is, if the flash discharge tube is placed in a light environment, the gas enclosed in the flash discharge tube is excited by light and it becomes easier for the flash discharge tube to emit light and conversely, if the flash discharge tube is placed in a dark environment, the excitation by light becomes null and it becomes relatively difficult for the flash discharge tube to emit light.

SUMMARY OF THE INVENTION

It is a primary object of the present invention to provide an electronic flash unit in which the noise produced when the flash discharge tube is excited is reduced.

It is a secondary object of the present invention to provide an electronic flash unit in which the reduction of said noise and the ease with which the flash discharge tube emits light are enhanced.

The invention will become fully apparent from the following detailed description thereof taken in conjunction with the accompanying drawings.

BRIEF DESCRIPTION OF THE DRAWINGS

FIG. 2(*b*) shows the voltage waveform of trigger pulse when the same electronic flash tube is placed in a light environment.

DESCRIPTION OF THE PREFERRED EMBODIMENTS

Figure 1:
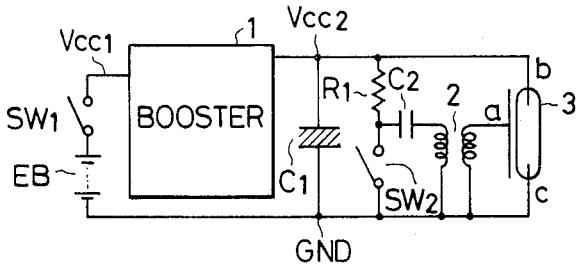
FIG. 1 is a schematic view showing the electronic flash unit according to the prior art in a simplified fashion.
Figure 2:
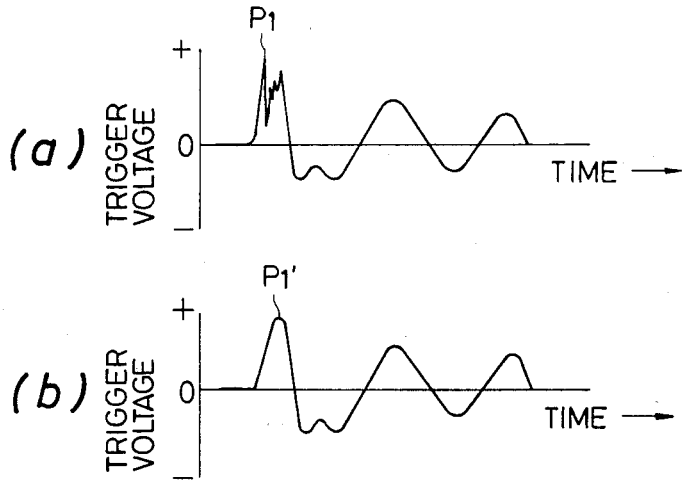
FIG. 2(*a*) shows the voltage waveform of trigger pulse when the electronic flash tube of the electronic flash unit according to the prior art is placed in a dark environment.

How the present invention has been realized will now be described roughly. FIG. 1 is a conceptional view depicting an electronic flash unit in a very much simplified fashion, and FIG. 2 shows the output voltage waveform of a trigger circuit. When a main switch SW1 is closed, the voltage of a battery EB is applied between power source lines $Vcc_1$–GND. When the main switch SW1 is closed, a boosting circuit (DC-DC converter) 1 boosts the voltage of the battery EB and applies it between high voltage source lines $Vcc_2$–GND. A main capacitor C1 is charged by this high voltage. Simultaneously therewith, a trigger capacitor C2 is charged through a resistor R1. Now, when a synchro contact SW2 is closed, the charge in the trigger capacitor C2 flows through the primary winding of a trigger coil 2 and therefore, a high voltage trigger pulse is induced in the secondary winding of the trigger coil 2. This trigger pulse is discharged from the trigger electrode a of a flash discharge tube 3 to the cathode electrode c thereof. With this discharge as the trigger, the charge in the main capacitor C1 is discharged between the anode electrode b and the cathode electrode c of the flash discharge tube 3, whereby emission of flashlight is started.

When the voltage waveform of the trigger pulse was measured to examine the nature of noise produced during the excitation of the flash discharge tube 3, the following result was obtained in accordance with the brightness of the environment in which the flash discharge tube 3 was placed. When the flash discharge tube 3 is placed in a dark environment, a high frequency noise component is included in the trigger pulse, particularly the first pulse $P_1$ thereof, as shown in FIG. 2(*a*). This noise is a high frequency of several hundred megahertz and is discharged into the space and the circuit system of the electronic flash unit. This noise is also propagated to the circuit system of the camera through the space or a part of the circuit system of the electronic flash unit. This has been the cause of the malfunctioning of each circuit system. On the other hand, when the flash discharge tube 3 was placed in a light environxent, the high frequency noise component was not included in the trigger pulse, particularly the first pulse $P_1'$ thereof, as shown in FIG. 2(*b*). That is, it has been found that discharging of the high frequency noise can be prevented if the flash discharge tube 3 is placed in a light environment prior to the excitation thereof. The present invention has been realized on the basis of such result of experiment.

Figure 3:
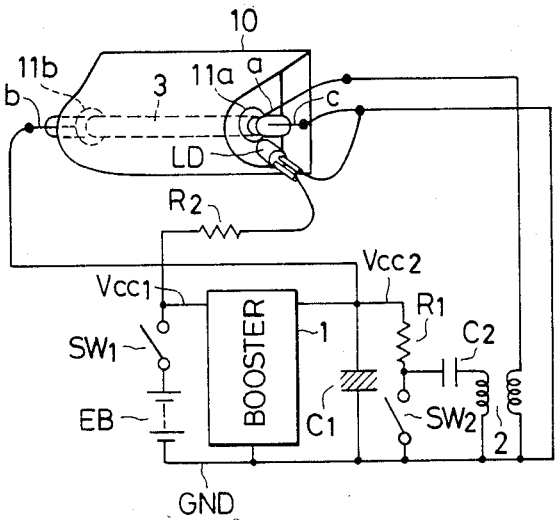
FIG. 3 shows the wiring of a first embodiment of the present invention.

The present invention will hereinafter be described with respect to some embodiments thereof. FIG. 3 shows a first embodixent of the present invention. In FIG. 3, elements similar in function to those in FIG. 1 are given similar reference characters. The flash discharge tube 3 is inserted in a reflector (reflecting shade) 10 through holes provided in the opposite sides thereof. The flashlight emitting portion of the flash discharge tube 3 is disposed at a region surrounded by the concave reflecting surface of the reflector. Bushings 11*a* and 11*b* fitted in the holes of the reflector serve to fix the flash discharge tube 3 and the reflector 10. A light-emitting diode LD is connected between the power source lines $Vcc_1$–GND through a resistor R2. The light-emitting diode LD is disposed so as to apply its light from the cathode electrode c of the flash discharge tube 3 projected from the bushing 11*a* outwardly of the reflector 10 into the flash discharge tube. The flash discharge tube 3 comprises a transparent glass tube enclosing therein xenon gas or the like which is an inert gas, and the opposite ends of the glass tube are sealed with the anode electrode b and the cathode electrode c being projected outwardly and therefore, the light of the light-emitting diode LD can illuminate the interior of the flash discharge tube.

Now, when the main switch SW1 is closed, the light-emitting diode LD emits light due to the battery voltage. Thus, the flash discharge tube 3 is placed in a light environment. Thereafter, when the synchro contact SW2 is closed in association with the photographing operation, emission of flashlight is started as previously described. At this time, the flash discharge tube 3 is brightly illuminated and therefore, production of high frequency noise is prevented. In this embodiment, the light-emitting diode LD emits light as long as the main switch SW1 is closed.

Figure 4:
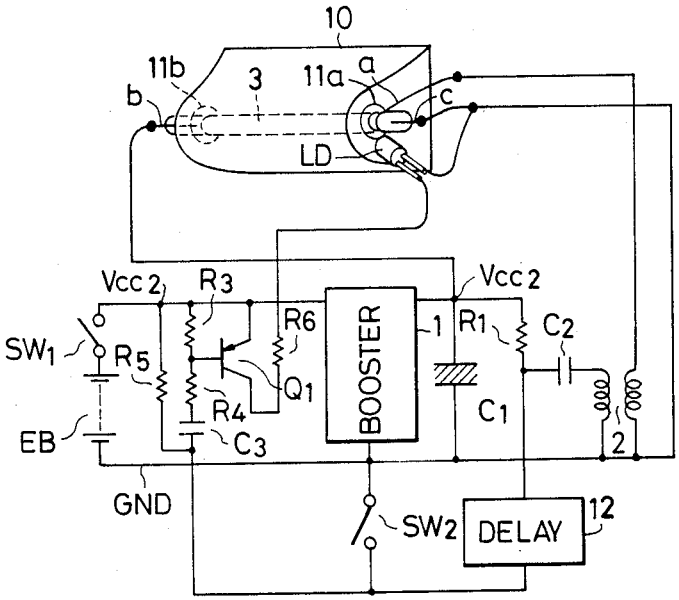
FIG. 4 shows the wiring of a second embodiment of the present invention.

FIG. 4 shows the wiring of a second embodiment of the present invention. In FIG. 4, elements similar in function to those in FIG. 2 are given similar reference characters. A timer circuit comprising resistors R3, R4, R5, a capacitor C3 and a synchro contact SW2 are series-connected between the power source lines $Vcc_1$–GND. The base of a switching transistor Q1 is connected to the junction between the resistors R3 and R4. A light-emitting diode LD is connected between the power source lines $Vcc_1$–GND through the switching transistor and resistor R6. A delay switch circuit 12 conducts to form a discharge loop passing through a trigger capacitor, the primary winding of a trigger transformer 2 and a synchro contact SW2 when a predetermined time elapses after the synchro contact SW2 is closed.

Now, when the synchro contact SW2 is closed with the main switch SW1 closed, the capacitor C3 begins to be charged. Accordingly, the base voltage of the transistor Q1 gradually rises from a predetermined level determined by the resistors R3 and R4 and therefore, the transistor Q1 is turned on to turn on the light-emitting diode LD. Thus, the flash discharge tube 3 is placed in a light environment. Thereafter, when a predetermined time elapses, the delay switch circuit 12 conducts and causes the trigger capacitor C2 to discharge. Therefore, emission of flashlight is started. The time interval from after the transistor Q1 is turned on until the delay switch circuit 12 conducts is set to permit a trigger pulse to be applied to the flash discharge tube 3 after the light-emitting diode LD is turned on, and several to several tens of microseconds is sufficient as such time interval. The period of time during which the transistor Q1 remains conductive is made equal to or greater than the period of time during which the trigger pulse is applied to the flash discharge tube 3. According to this embodiment, the light-emitting diode LD is turned on for a predetermined period of time in response to the closing of the synchro contact, and this is preferable in saving the electric power.

Figure 5:
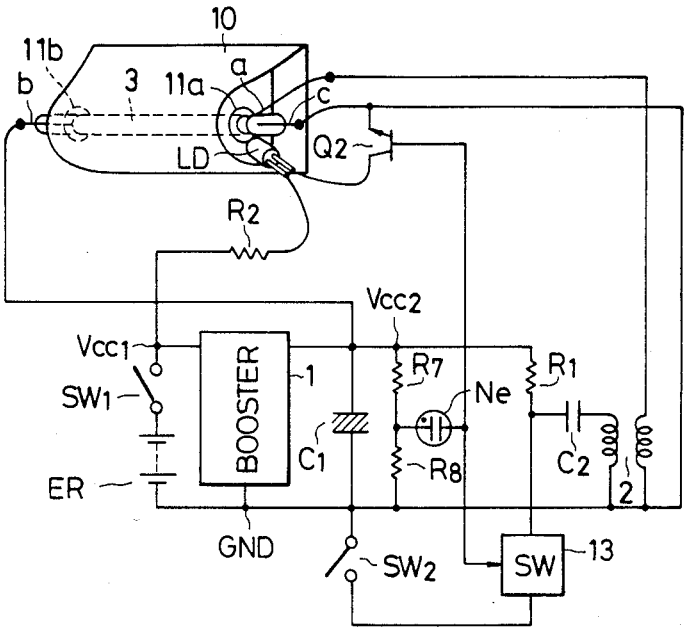
FIG. 5 shows the wiring of a third embodiment of the present invention.

FIG. 5 shows the wiring of a third embodiment of the present invention. In FIG. 5, elements similar in function to those in FIG. 2 are given similar reference characters. Voltage dividing resistors R7 and R8 divide the charging voltage of the main capacitor C1. When this divided voltage comes to correspond to a predetermined voltage suitable for the flashlight emission of the flash discharge tube 3 (when the charging of the main capacitor is completed), a neon tube Ne discharges and conducts. A switching transistor Q2 connected between the power source line GND and the light-emitting diode LD is turned on when the neon tube Ne conducts. A switch circuit 13 connected to the discharge loop of a trigger capacitor C2 closes the discharge loop when the neon tube Ne conducts.

Now, when the main switch SW1 is closed, the charging of the main capacitor C1 and the trigger capacitor C2 is started. When the charging of the main capacitor C1 is completed, the neon tube Ne is turned on and conducts. Thereupon, the transistor Q2 is turned on to turn on the light-emitting diode LD. Simultaneously therewith, the switch circuit 13 also becomes conductive, but at this time, the synchro switch SW2 is still open and therefore, the trigger capacitor C2 does not discharge. Next, when the synchro contact SW2 is closed during photographing, the trigger capacitor C2 discharges and therefore, the flash discharge tube 3 starts to emit flashlight. When the charging voltage of the main capacitor C1 is reduced by this flashlight emission, the neon tube Ne is turned off and becomes non-conductive, so that the transistor Q2 is turned off. Thus, the light-emitting diode LD is turned off after the flashlight emission. In this embodiment, the light-emitting diode LD is turned on in association with the completion of the charging of the main capacitor C1 and therefore, this embodiment is more excellent in respect of the electric power saving than the first embodiment.

Figure 6:
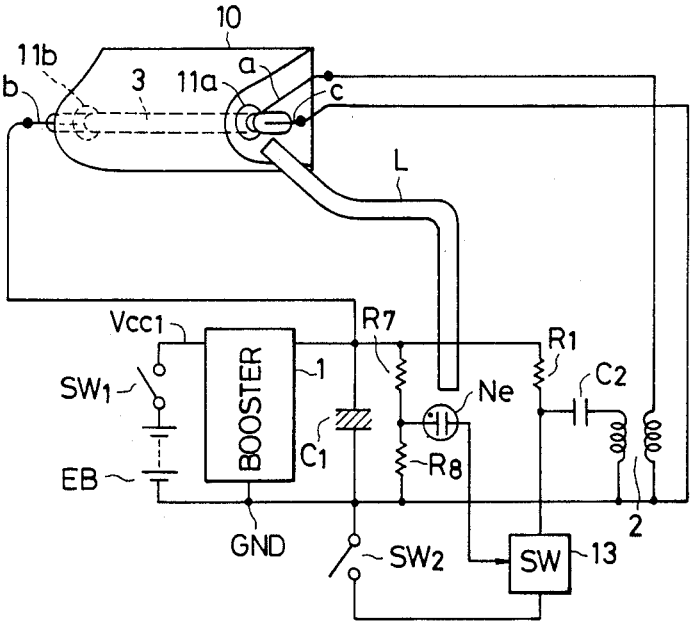
FIG. 6 shows the wiring of a fourth embodiment of the present invention.

FIG. 6 shows the wiring of a fourth exbodiment. In this embodinent, the light of the neon tube Ne, instead of the light of the light-emitting diode LD in the embodiment of FIG. 5, is directed for the illumination of the flash discharge tube 10 by a light guide L.

Figure 7:
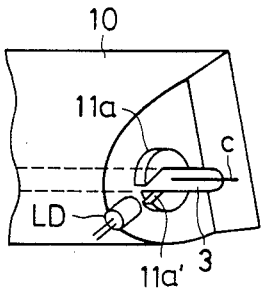
FIGS. 7 to 11 show the arrangement relation between a light-emitting diode and a reflector.
Figure 8:
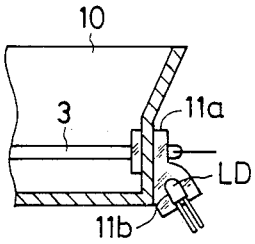
Figure 9:
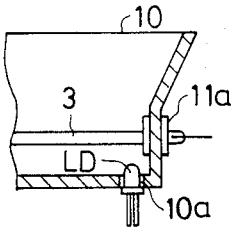
Figure 10:
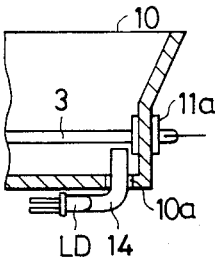
Figure 11:
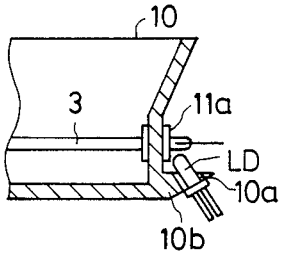

FIGS. 7 to 11 show the arrangement relation between the light-emitting diode LD and the reflector 10. In FIG. 7, the bushing 11*a* is provided with a cut-away 11*a*', and the light from the light-emitting diode LD is applied into the flash discharge tube 3 through the cut-away 11*a*'. In FIG. 8, the bushing 11*a* is formed of a transparent material. The bushing 11*a* is also provided with a holding portion 11*b* for containing and holding the light-emitting diode LD therein. Accordingly, by the light-emitting diode LD being contained and held in the recess, the light from the light-emitting diode is efficiently directed to the flash discharge tube 3. Also, the holding structure for the light-emitting diode becomes simple. In FIG. 9, the light-emitting diode LD is disposed in opposed relationship with the flash discharge tube 3 by being inserted in a hole 10*a* formed in the reflector 10. In FIG. 10, the light of the light-emitting diode LD disposed parallel to the reflector 10 is applied to the flash discharge tube 3 through a light guide 14 extending through the hole 10*a* of the reflector 10. In FIG. 11, the light-emitting diode LD is inserted in the hole 10*a* formed in a holding portion 10*b* projectedly provided on the reflector 10 and is secured to the hole 10*a* as by an adhesive agent.

In the embodiments hitherto described, the discharge tube and the light-emitting element are provided separately from each other, but alternatively, the light-emitting element may be provided inside or outside the discharge tube integrally with the discharge tube.

Figure 12:
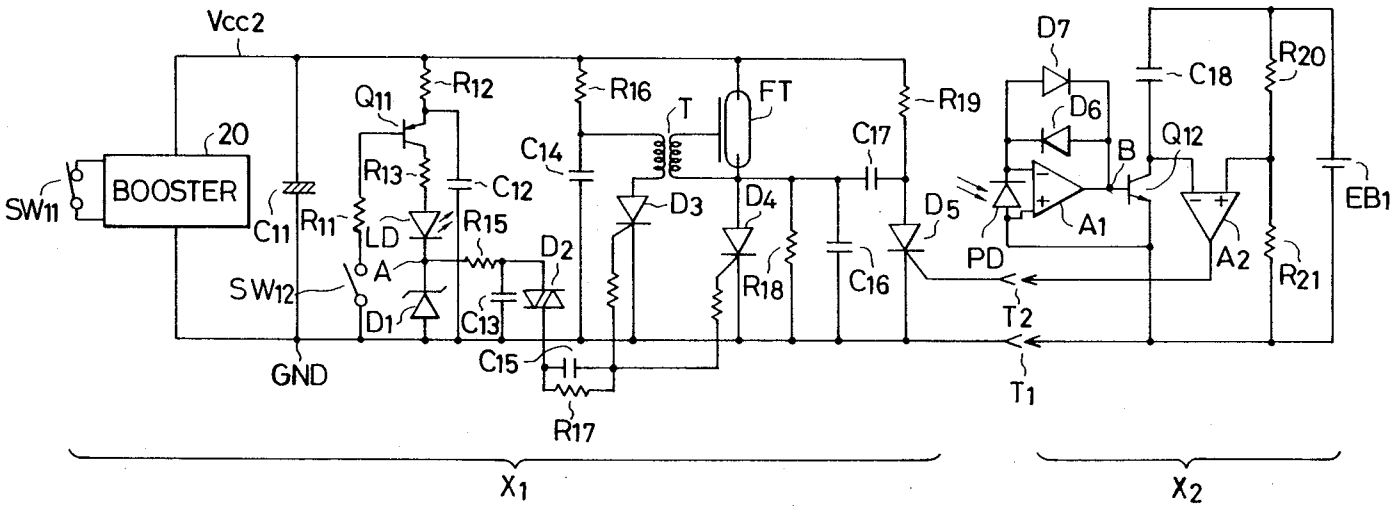
FIG. 12 is a circuit diagram of a fifth embodiment of the present invention applied to a TTL flash output control type electronic flash unit.

FIG. 12 is a circuit diagram of a fifth embodiment in which the present invention is applied to a TTL flash output control type electronic flash unit. In FIG. 12, a circuit system $X_1$ is the circuit of the power source portion, trigger portion and light-emitting portion of the electronic flash unit, and a circuit system $X_2$ is the circuit of a light emission stopping portion provided in the camera. These two circuit systems are connected through connectors $T_1$ and $T_2$ by the electronic flash unit being mounted on the camera. Electric power is supplied from the battery EB1 of the camera to the circuit system $X_2$. The construction and operation of this circuit will hereinafter be described together.

First, when the main switch SW11 is closed, a boosting circuit 20 is operated and the power source lines $Vcc_2$–GND are energized. A main capacitor C11 for accumulating the light energy of a flash discharge tube FT therein is then charged. Also, a capacitor C12 is charged through a resistor R12, a trigger capacitor C14 is charged through a resistor R16, and a commutation capacitor C17 is charged through resistors R19 and R18.

When a trigger switch SW12 synchronized with the synchro contact of the camera is then closed, a transistor Q11 is turned on and the charge accumulated in the capacitor C12 flows into a Zener diode D1 through a serial circuit comprising the transistor Q11 parallel to the capacitor C12, the resistor R13 and the light-emitting diode LD and produces a predetermined voltage at point A. At this time, the light-emitting diode LD emits light and illuminates the flash discharge tube FT as previously described. On the other hand, when a voltage is produced at point A by the closing of the trigger switch SW12, a delay circuit comprising a resistor R15 and a capacitor C13 begins to operate. A delay gate energizing circuit is constituted by the capacitor C13, resistor R15 and diac D2 and, when the voltage of the capacitor C13 exceeds the break-over voltage of the diac D2, the diac D2 is turned on to turn on thyristors D3 and D4 through a capacitor C15 and a resistor R17. Thereupon, the trigger capacitor C14 discharges through the primary winding of a trigger coil T and the thyristor D3 and therefore, a high voltage trigger pulse is applied to the flash discharge tube FT. As a result, the flash discharge tube FT starts to emit light. On the other hand, the light-emitting diode LD continues to exit light during the time that transistor Q11 remains conductive, namely during or over the time that the trigger pulse is produced. At the early stage of the discharging of the capacitor C12, a high voltage is applied to the light-emitting diode LD, so that the light-emitting diode LD emits light at high brightness. This is convenient to make the flash discharge tube momentarily bright. Of course, the time constant of the delay circuit is determined so that the flash discharge tube emits light during this light emission at high brightness.

Now, the flashlight emitted from the flash discharge tube FT illuminates an object to be photographed and the reflected light therefrom arrives at a film through the picture-taking lens (not shown) of the camera. The light reflected by this film enters a photodiode PD. At the output terminal B of the head amplifier A1 of the photodiode PD, there is produced a voltage proportional to the logarithm of a photocurrent $$\frac{KT}{q} \ln \frac{I_D}{I_S}$$

(K: Boltzman constant; T: absolute temperature; q: charge of electron; $I_D$: photocurrent of photodiode PD; $I_S$: saturated current in the reverse direction of diode $D_6$). When this voltage is applied between the base and emitter of the transistor Q12, there is a relation that $$VBE = \frac{KT}{q} \ln \frac{I_C}{I_S},$$

where VBE is the base-emitter voltage of the transistor Q12 and $I_C$ is the collector current of the transistor Q12. When this equation is compared with the output voltage at the aforementioned point B, $I_C \approx I_D$ and thus, the same current as the photocurrent $I_D$ flows to the collector of the transistor Q12. Accordingly, this current is integrated by a capacitor C18 and the integrated voltage is compared with a reference voltage produced by resistors R20 and R21, by a comparator circuit A2. When the integrated voltage reaches a predetermined relation with the reference voltage, there is produced a signal which turns on a thyristor D5. When the thyristor D5 is turned on, the charging voltage of the commutation capacitor C17 is applied as a reverse voltage to the thyristor D4 and therefore, the thyristor D4 is turned off. When the thyristor D4 is turned off, the discharging circuit of the discharge tube FT is opened and thus, flash discharge is stopped. Accordingly, the quantity of emitted light (intensity of light x light emission continuation time) is controlled by the time during which, in a metering circuit, the integrated value of a current proportional to the metered value reaches a predetermined comparison voltage value.

In the above-described embodiments, the light-emitting diode has been used for illuminating the flash discharge tube, but other light-emitting elements may be used without departing from the scope of the present invention.

We claim:

1. An electronic flash unit for emitting flashlight toward an object to be photographed in order that a camera may obtain proper exposure, comprising:

(a) flash means having a flash tube which emits flashlight;

(b) means for driving said flash tube in order that said flash tube may emit flashlight, said driving means including capacitor means chargeable with charge and producing a voltage corresponding to the charge;

means for supplying charge to said capacitor means;

trigger means for applying a trigger to said flash tube in order that said flash tube may emit flastlight; and means responsive to the triggering of said flash tube by said trigger means to discharge the charge in said capacitor toward said flash tube;

(c) means for applying light to the interior of said flash tube prior to said driving means causing said flash tube to emit flashlight; and (d) operating means for said supply means to start the supply of charge to said capacitor means and wherein said means for applying light applies light to the interior of said flash tube in response to operation of said operating means.

2. An electronic flash unit for emitting flashlight toward an object to be photographed in order that a camera may obtain proper exposure, comprising:

(a) flash means having a flash tube which emits flashlight;

(b) means for driving said flash tube in order that said flash tube may emit flashlight, said driving means including capacitor means chargeable with charge and producing a voltage corresponding to the charge;

means for supplying charge to said capacitor means;

trigger means for applying a trigger to said flash tube in order that said flash tube may emit flashlight; and means responsive to the triggering of said flash tube by said trigger means to discharge the charge in said capacitor toward said flash tube;

(c) means including a light emitting element for applying light to the interior of said flash tube prior to said driving means causing said flash tube to emit flashlight; and wherein said trigger means includes delay means for applying a trigger to said flash tube after lapse of a predetermined time after said means for applying light has started the application of light to said flash tube.

3. An electronic flash unit according to claim 2, wherein said flash means includes light reflecting means having a light reflecting surface inside thereof for reflecting the flashlight emitted by said flash tube toward a predetermined range, said light reflecting means being provided so as to cover the circumference of said flash tube with a portion thereof left open, said light-emitting element is secured to the outside of said reflecting means, one end of said flash tube is provided so as to project outside said light reflecting means, and said flash tube introduces the light from said light-emitting element through said projected one end.

4. An electronic flash unit for emitting flashlight toward an object to be photographed in order that a camera may obtain proper exposure, comprising:

(a) flash means having a flash tube which emits flashlight;

(b) means for driving said flash tube in order that said flash tube may emit flashlight, said driving means including capacitor means chargeable with charge and producing a voltage corresponding to the charge;

means for supplying charge to said capacitor means;

trigger means for applying a trigger to said flash tube in order that said flash tube may emit flashlight; and means responsive to the triggering of said flash tube by said trigger means to discharge the charge in said capacitor toward said flash tube;

(c) means for applying light to the interior of said flash tube prior to said driving means causing said flash tube to emit flashlight; and wherein said means for applying light includes:

means for detecting that the voltage produced by said capacitor means has reached a predetermined voltage; and means for applying light to said flash tube in response to the fact that the voltage produced by said capacitor means has reached said predetermined voltage.

5. An electronic flash unit for emitting flashlight toward an object to be photographed in order that a camera may obtain proper exposure, comprising:

(a) flash means having a flash tube which emits flashlight;

(b) means for driving said flash tube in order that said flash tube may emit flashlight, said driving means including capacitor means charged with charge and producing a voltage corresponding to the charged charge, means for supplying charge to said capacitor means, trigger means for applying a trigger to said flash tube in order that said flash tube may emit flashlight and means responsive to the triggering of said flash tube by said trigger means to discharge the charge charged in said capacitor toward said flash tube;

(c) means for applying light to the interior of said flash tube prior to said driving means causing said flash tube to emit flashlight; and (d) timer means for inhibiting said applying means from applying light to said flash tube in response to lapse of a predetermined time after said trigger means has applied a trigger to said flash tube.

* * * * *

UNITED STATES PATENT AND TRADEMARK OFFICE

CERTIFICATE OF CORRECTION

PATENT NO. : 4,555,648

DATED : November 26, 1985

INVENTOR(S) : YOSHIKAZU IIDA, ET AL.

It is certified that error appears in the above-identified patent and that said Letters Patent are hereby corrected as shown below:

Column 3, line 1, change "envoronxent" to --environment--.

Column 5, line 66, change "exit" to --emit--.

Signed and Sealed this

*Fourth* Day of *February 1986*

[SEAL]

*Attest:*

DONALD J. QUIGG

*Attesting Officer*

*Commissioner of Patents and Trademarks*